US011758348B1

(12) United States Patent
King et al.

(10) Patent No.: US 11,758,348 B1
(45) Date of Patent: Sep. 12, 2023

(54) AUDITORY ORIGIN SYNTHESIS

(71) Applicant: Apple Inc., Cupertino, CA (US)

(72) Inventors: Jared King, Los Angeles, CA (US); Shai Messingher Lang, Santa Clara, CA (US); Symeon Delikaris Manias, Los Angeles, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/570,251

(22) Filed: Jan. 6, 2022

Related U.S. Application Data

(60) Provisional application No. 63/134,840, filed on Jan. 7, 2021.

(51) Int. Cl.
*H04S 7/00* (2006.01)
*H04S 5/00* (2006.01)

(52) U.S. Cl.
CPC ..... *H04S 7/303* (2013.01); *H04S 5/00* (2013.01); *H04S 2420/11* (2013.01)

(58) Field of Classification Search
None
See application file for complete search history.

(56) References Cited

U.S. PATENT DOCUMENTS

| | | | | |
|---|---|---|---|---|
| 10,609,485 | B2 | 3/2020 | Nawfal et al. | |
| 2015/0131824 | A1* | 5/2015 | Nguyen | H04S 7/307 381/300 |
| 2020/0154229 | A1* | 5/2020 | Habets | H04S 7/304 |

FOREIGN PATENT DOCUMENTS

| | | |
|---|---|---|
| WO | 2018064528 | 4/2018 |

OTHER PUBLICATIONS

Choueiri, Edgar, "Virtual Navigation of Ambisonics-Encoded Sound Fields," 3D3A Lab at Princeton University, Retrieved from the Internet <https://www.princeton.edu/3D3A/AmbisonicsNavigation.html> on Nov. 16, 2020, 2 pages.

Belloch, Jose A., et al., "Headphone-based spatial sound with a GPU accelerator," International Conference on Computational Science, ICCS 2012, Procedia Computer Science 9 (2012), Dec. 2012, 11 pages.

Tylka, Joseph G., et al., "Soundfield Navigation using an Array of Higher-Order Ambisonics Microphones," AES International Conference on Audio for Virtual and Augmented Reality, Sep. 30, 2016, 22 pages.

Tylka, Joseph G., et al., "Fundamentals of a Parametric Method for Virtual Navigation Within an Array of Ambisonics Microphones," J. Audio Eng. Soc., vol. 68, No. 3, Mar. 2020, pp. 120-137.

(Continued)

*Primary Examiner* — Kenny H Truong
(74) *Attorney, Agent, or Firm* — Aikin & Gallant, LLP

(57) ABSTRACT

Each of a plurality of virtual loudspeaker arrays and their channels are produced, based on a corresponding microphone array and microphone signals thereof. Channels of a hallucinated loudspeaker array are determined based on the channels of the plurality of virtual loudspeaker arrays. The plurality of virtual loudspeaker arrays and the hallucinated loudspeaker array share a common geometry and orientation. Spatial audio is rendered based on the channels of the hallucinated loudspeaker array.

19 Claims, 6 Drawing Sheets

(56) References Cited

OTHER PUBLICATIONS

Tylka, Joseph George, "Virtual Navigation of Ambisonics-Encoded Sound Fields Containing Near-Field Sources," A Dissertation presented to the faculty of Princeton University in candidacy for the Degree of Doctor of Philosophy, Jun. 2019, 264 pages.
Tylka, Joseph G., et al., "Domains of Practical Applicability for Parametric Interpolation Methods for Virtual Sound Field Navigation," J. Audio Eng. Soc., vol. 67, No. 11, Nov. 2019, pp. 882-893.
Tylka, Joseph G., et al., "Performance of Linear Extrapolation Methods for Virtual Sound Field Navigation," J. Audio Eng. Soc., vol. 68, No. 3, Mar. 2020, pp. 138-156.
Tylka, Joseph G., et al., "Algorithms for Computing Ambisonics Translation Filters," 3D3A Lab Technical Report #2, Mar. 5, 2019, 10 pages.
Tylka, Joseph G., et al., "Models for evaluating navigational techniques for higher-order ambisonics," Proceedings of Meetings on Acoustics, vol. 30, 050009, Jun. 25-29, 2017, 15 pages.
Tylka, Joseph G., et al., "Soundfield Navigation using an Array of Higher-Order Ambisonics Microphones," Audio Engineering Society Conference Paper, Sep. 30, 2016, 10 pages.
Tylka, Joseph G., et al., "Comparison of Techniques for Binaural Navigation of Higher-Order Ambisonic Soundfields," Audio Engineering Society Convention Paper 9421, Oct. 29, 2015, 13 pages.

* cited by examiner

AUDITORY ORIGIN SYNTHESIS

CROSS-REFERENCE TO RELATED APPLICATIONS

This application claims priority to U.S. Provisional Patent Application No. 63/134,840 filed Jan. 7, 2021, which is incorporated herein in its entirety.

FIELD

One aspect of the disclosure relates to performing auditory origin synthesis.

BACKGROUND

Humans can estimate the location of sounds around them by analyzing the sounds at their two ears through a psychoacoustic process called binaural perception. The human auditory system localizes the direction of sounds through a variety of auditory cues resulting from the way sounds interact with the body; such as the way sound waves diffract around and reflect off of our bodies and head, interact with our pinna, and differences in timing when a sound arrives at one ear compared to the other. These being acoustic properties, these same spatial cues can be artificially generated and replicated using spatial audio filters.

Audio can be rendered for playback with spatial filtering so that the audio is perceived to have spatial qualities, for example, originating from a location above, below, or to a side of a listener. The spatial filters can artificially impart spatial cues into the audio that resemble the diffractions, delays, and reflections that are naturally caused by our body geometry and pinna. The spatially filtered audio can be produced by a spatial audio reproduction system and output through headphones or one or more loudspeakers (a reproduction system).

Multi-channel microphone arrays have multiple transducers that generate microphone audio signals. These microphone audio signals may be processed to determine spatial properties of the acoustic environment captured by the microphone. Computer systems, including mobile devices, or other electronic systems, can process audio for playback to a user. For example, a computer can launch a movie player application that, during runtime, plays sounds from the movie back to the user. Other applications, such as video calls, phone calls, alarms, games, and more, can have one or more sound sources. These sounds can be rendered spatially in a spatial audio environment using artificially generated spatial filtering techniques.

SUMMARY

Systems and methods are lacking when it comes to synthesizing shifting auditory origin points from a perspective of a user, as the user moves through a virtual environment that can contain audio and visual components that are synchronized and concurrent, both in time and in spatial placement. Single ambisonic audio origin sources can capture a sound field that is then dynamically spatially filtered using input HMD tracking data to create a stereo binaural audio output that is accurate to the user's static visual origin point and auditory perspective. Such a system, however, is only accurate from the single "known" ambisonic origin point, or the physical capture point of an ambisonic microphone. Audio-visual correlation breaks down once the visual origin of the user moves out into a third synthesized dimension, for example, forward in space, side to side, or up and down.

Captured signals from microphone arrays can then rendered for playback using different kind of formats such as surround binaural, stereo or a hallucinated virtual loudspeaker array. In some aspects, a hallucinated multichannel loudspeaker array and/or virtual microphone array can be rendered. Such a hallucinated loudspeaker or virtual microphone array can have a point of origin that exists in space between the locations of two or more physical multichannel microphone arrays. This hallucinated loudspeaker or virtual microphone array can be a be applied in various applications that contain audio, for example, in an extended reality (XR) setting.

Using multiple capture points in space we can move between them by creating a virtual capture point/virtual microphone array. This array can create a virtual ambisonic soundfield between know capture points. A virtual microphone array can create a virtual ambisonic soundfield between known capture points. Tracking data of a user can include translational and/or rotational position of the user (e.g., a user's head). Such tracking data can be used to manipulate a hallucinated loudspeaker or virtual microphone array to produce ambisonic 6 degrees of freedom (6doF) movement, which can be used for example, in a live-capture XR setting, a videogame, an immersive user tutorial, or other interactive media setting.

In some aspects of the present disclosure, audio can be interpolated between two or more multi-channel audio capture devices. A system and method is described that renders a 'virtual' auditory origin point at any point in space between multiple 'known' ambisonic origin points within a defined capture area. From this derived virtual origin point, a binaural output can then be rendered based on positional information of a user (e.g., from a user's device and/or external sensors). The virtual auditory origin can be updated as a user moves, thus providing accurate audio visual correlation in interactive media applications.

In some aspects, a method is described that produces spatial audio based on a hallucinated loudspeaker array. A plurality of virtual loudspeaker arrays and channels thereof are produced based on corresponding microphone arrays and microphone signals thereof. Channels of a hallucinated loudspeaker array are determined based on the channels of the plurality of virtual loudspeaker arrays, where the plurality of virtual loudspeaker arrays and the hallucinated loudspeaker array share a common geometry. Spatial audio can be generated based on the channels of the hallucinated loudspeaker array. In such a manner, an auditory origin of a sound scene is synthesized at a location between capture locations of real microphone arrays. This auditory origin can correspond to a virtual position (e.g., translation and/or rotation) of a user relative to the sound scene. A hallucinated loudspeaker array is a virtual construct having channels that are generated based on channels of virtual loudspeaker arrays, as described in further detail in the present disclosure. A virtual loudspeaker array is a virtual construct having channels that are generated based on microphone signals of a physical microphone array.

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the Claims section. Such combinations may have particular advantages not specifically recited in the above summary.

BRIEF DESCRIPTION OF THE DRAWINGS

Several aspects of the disclosure here are illustrated by way of example and not by way of limitation in the figures of the accompanying drawings in which like references indicate similar elements. It should be noted that references to "an" or "one" aspect in this disclosure are not necessarily to the same aspect, and they mean at least one. Also, in the interest of conciseness and reducing the total number of figures, a given figure may be used to illustrate the features of more than one aspect of the disclosure, and not all elements in the figure may be required fora given aspect.

DETAILED DESCRIPTION

Several aspects of the disclosure with reference to the appended drawings are now explained. Whenever the shapes, relative positions and other aspects of the parts described are not explicitly defined, the scope of the invention is not limited only to the parts shown, which are meant merely for the purpose of illustration. Also, while numerous details are set forth, it is understood that some aspects of the disclosure may be practiced without these details. In other instances, well-known circuits, algorithms, structures, and techniques have not been shown in detail so as not to obscure the understanding of this description.

Figure 1:
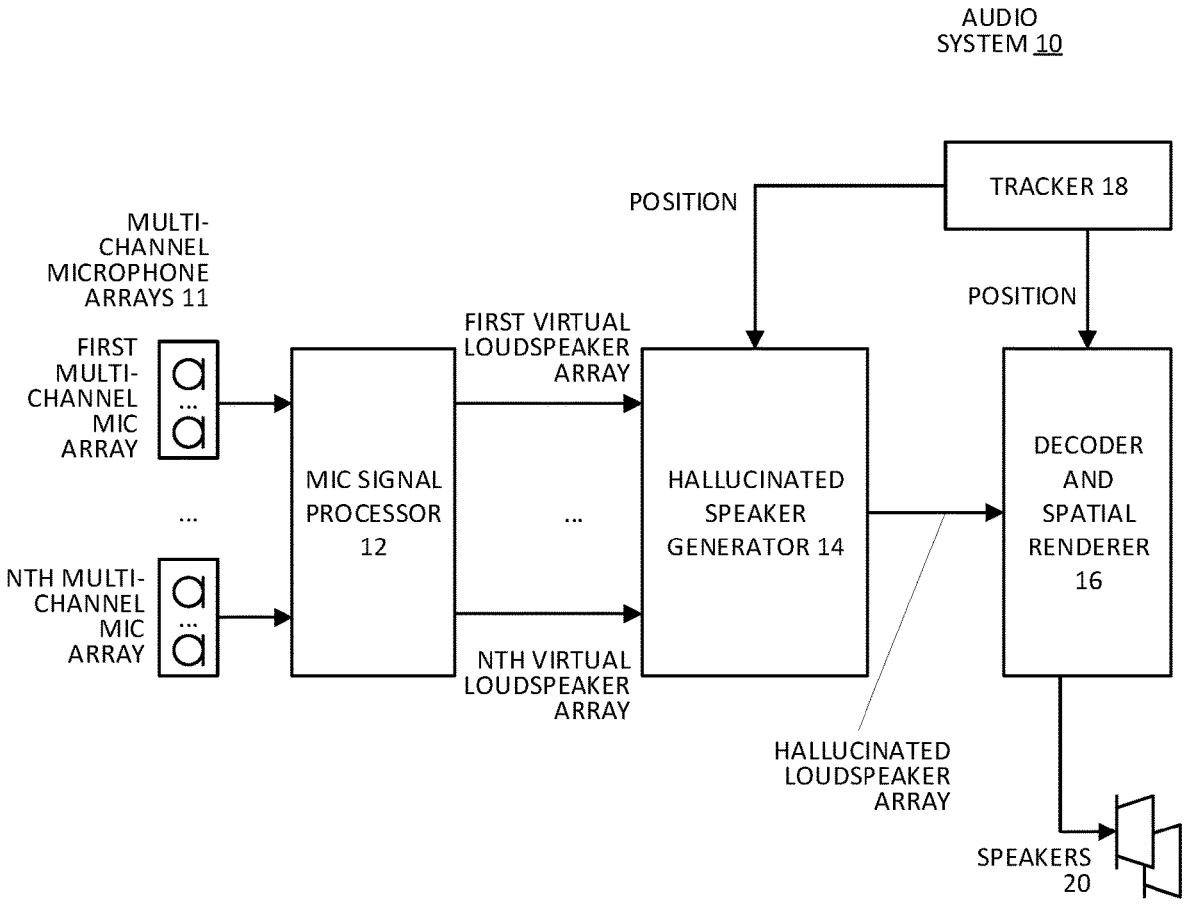
FIG. 1 shows a system and process for rendering spatial audio with a hallucinated loudspeaker array, according to some aspects.

FIG. 1 shows a system and process for rendering spatial audio from a hallucinated loudspeaker array, according to some aspects. An audio system 10 can include a plurality of multi-channel microphone arrays 11, for example, N number of multi-channel microphone arrays. In some aspects, an audio system can include one or more electronic devices such as, for example, a laptop computer, a microphone array (e.g., an ambisonic microphone), a smart phone, a tablet computer, a smart speaker, or a head mounted display (HMD). Each of the electronic devices can serve as a microphone array. For example, microphone arrays 11 can include three microphone arrays (a smart phone, an HMD, and an ambisonic microphone) located at different capture points.

A multi-channel microphone array can be a microphone with a plurality of microphone transducers having fixed and/or known geometry. Microphone transducers of a microphone array can work in tandem (e.g., the signals are processed simultaneously) so that spatial aspects of sound (e.g., time of arrival and differences in gains between the microphone signals) are observed. A microphone array can include omnidirectional microphones, directional microphones, or a mix of omnidirectional and directional microphones distributed with a fixed geometry (e.g., arranged about the perimeter of a device). In some aspects, a microphone array can be an audio system with a plurality of microphone transducers, such one of the audio systems mentioned herein.

In some aspects, one or more of the microphone arrays are ambisonic microphones. Ambisonic microphones can have a plurality of sub-cardioid microphones pointed in different directions. In some aspects, an ambisonic microphone can include four or more sub-cardioid microphones arranged as a tetrahedral or greater array.

At block 12, a plurality of virtual loudspeaker arrays and their respective channels, are produced. Each of the virtual loudspeaker arrays and their respective channels can be produced based on a corresponding microphone array and microphone signals thereof. For example, the first microphone array and signals thereof are used to produce the first virtual loudspeaker array, and so on. A known audio algorithm such as, for example, beamforming, least-squares (e.g., solving for a least-squares problem), ambisonics, or other audio formats or codecs can be used to produce the channels of the virtual loudspeaker arrays from the respective microphone array.

In some aspect, ambisonic decoders such as mode matching, allrad or perceptually motivated can be utilized. Examples of ambisonic decoders are discussed in the following: Moreau, Sébastien, Jérôme Daniel, and Stéphanie Bertet, "3D sound field recording with higher order ambisonics—Objective measurements and validation of a 4th order spherical microphone", 120th Convention of the AES 2006; Pulkki, Ville, "Parametric time-frequency domain spatial audio", Eds; "Parametric Time-frequency Domain Spatial Audio" Ville Pullki, Symeon Delikaris-Manias, and Archontis Politis, John Wiley & Sons, Incorporated, 2018, APA; Zotter, Franz, and Matthias Frank, "All-round ambisonic panning and decoding", Journal of the audio engineering society 60.10 (2012): 807-820, APA.

At block 14, channels of a hallucinated loudspeaker array are determined based on the channels of the plurality of virtual loudspeaker arrays. Determining the channels of the hallucinated loudspeaker array can include determining a contribution of each channel of each of the plurality of virtual loudspeaker arrays, to a corresponding channel of the hallucinated loudspeaker array.

For example, if each of the virtual loudspeaker arrays have five channels, then each of the five channels of the hallucinated loudspeaker array can be determined based on a contribution (or a weight) of the corresponding channel of the virtual loudspeaker arrays. This contribution can be dependent on where the hallucinated loudspeaker array is located relative to the locations of the virtual loudspeaker arrays (which can correspond to the capture locations of the multi-channel microphone arrays). For example, if the hallucinated loudspeaker array happens to be at the exact location of the first virtual loudspeaker array, then each channel of the hallucinated loudspeaker array can have a 100% contribution from the corresponding channels of the first virtual loudspeaker array, and little to no contribution from the remaining virtual loudspeaker arrays. If the hallucinated loudspeaker array has a location that is equidistant from the virtual loudspeaker arrays, then it can have equal contribution from the virtual loudspeaker arrays. In some aspects, the relationship between a) contribution and b) location of the hallucinated loudspeaker array to the virtual loudspeaker arrays is proportional. In some aspects, the relationship is non-linear.

The plurality of virtual loudspeaker arrays and the hallucinated loudspeaker array can share a common geometry and orientation. For example, each virtual loudspeaker array can have a plurality of virtual loudspeaker transducers that simulate generation of sound by converting the audio channels of each respective virtual loudspeaker array. Each of these virtual transducers can have a direction and a position, relative to some common point or coordinate system. Thus, each of the virtual loudspeaker arrays can have the same number of virtual transducers, each pointing in the same direction and having the same position as an equivalent transducer in another virtual array. Further, each virtual loudspeaker array, when taken as a whole, can have an orientation (e.g., in the common coordinate system shared by all the virtual loudspeaker arrays), and each of these orientations can also be the same in the common coordinate system, although the location of these virtual loudspeaker arrays will differ. The orientation can be expressed as a rotation (e.g., with spherical coordinates).

The location of the hallucinated loudspeaker array can be determined based on a tracked position of a user. A Tracker 18 can utilize one or more sensors to sense position of a user. Such sensors can include light sensors, a camera, an inertial measurement unit (IMU), microphones, wireless communications, or combinations thereof. For example, acoustic tracking can utilize time of arrival of sound at different microphones to determine where the user is. Wireless tracking can use triangulation to determine a 3D position. Camera images can be processed using visual odometry to determine a position and orientation of the camera (which can be worn by a user). Similarly, data from a user-worn IMU can be processed with localization algorithms to determine position of the user. Position of the user can include a translational position and/or a rotational position in three-dimensional space. The position can be specific to the user's head.

The position of the hallucinated speaker can be updated as the user moves about in real time, for example, in an interactive media application. In such a manner, an auditory origin of sound in an acoustic environment can be virtualized on the fly, and updated to reflect a sensed auditory position of the user.

At block 16, spatial audio is rendered based on the channels of the hallucinated loudspeaker array. Spatial rendering can be performed with decoder such as a binaural decoder. Spatial rendering or decoding can be performed by applying spatial filters to audio channels to generate a left audio channel and a right audio channel. The spatial filters can be selected or determined based on the based on the user's sensed position.

Spatial filters can include a head related transfer function (HRTF) in the frequency domain or head related impulse response (HRIR) in the time domain. Spatial filtering differs based on position of a sound relative to a user, thus as the user position changes, different spatial filters are applied to properly decode the channels of the hallucinated loudspeaker array to spatial audio. The resulting left and right audio channels can be used to drive left and right speakers (e.g., speaker 20) of a headphone set to form a spatialized audio environment through what is known as binaural audio. Spatialized audio maintains the illusion that one or more sounds originate from respective locations in the audio environment.

In some embodiments, the channels of the hallucinated loudspeaker array can be decoded directly to spatialized audio (e.g., binaural audio). Alternatively, the hallucinated loudspeaker can be encoded to a virtual microphone array, and microphone signals of the virtual microphone array are decoded to produce the spatial audio, as described further in other sections.

In such a manner, increases in audio resolution and auditory accuracy can be realized. Spatial resolution is improved by synthesizing audio at the location of the user, without requiring an exorbitant number of physical microphones or microphone arrays to capture a sound field. Similarly, bitrate and sample rate of the known auditory origin capture points within a region being captured can be maintained at a reasonable level. Virtual loudspeaker arrays can be rendered with a desirable resolution and with uniformity (e.g., a common geometry and number of channels). The number of auditory origins can be increased at will and on the fly, within the space delineated by the microphone arrays.

The audio system can be applied in different applications, such as XR, which can include augmented, virtual, and mixed reality. Spatial audio reproduction can be realized with 6 degrees of freedom (6doF). Further, audio assets can be generated at different locations for different applications. For example, during sports, film, or television production, audio assets can be generated in locations where no microphones were originally located, by determining virtual loudspeaker arrays from the physical microphone arrays, and then determining a hallucinated loudspeaker array. Audio assets can be generated by interpolating between two or more simultaneous but separate audio captures. In some applications, such as group events, multiple people can record audio simultaneously at different locations. An audio asset can be generated at locations delineated by where those people were recording.

Figure 2:
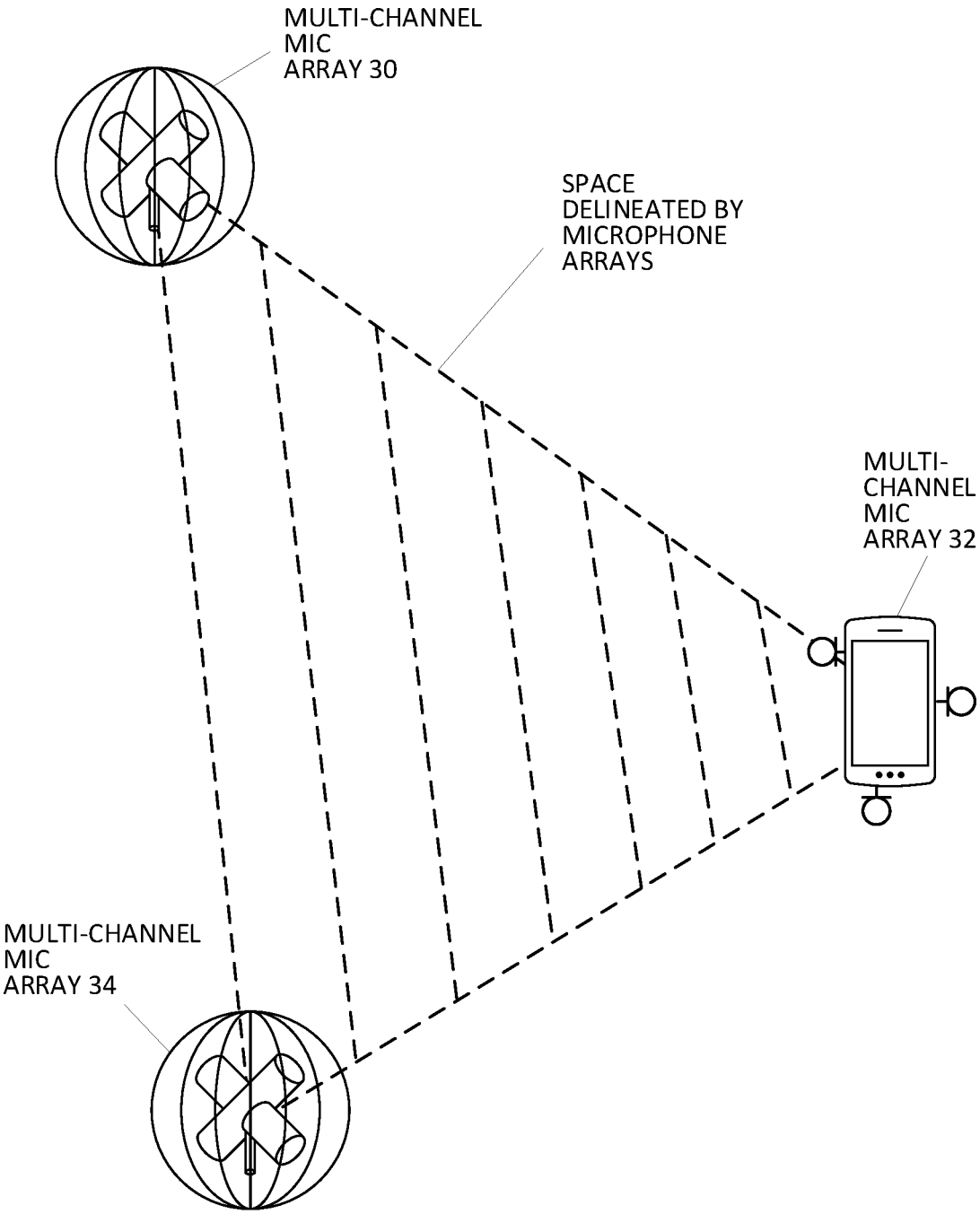
FIG. 2 shows an example of multi-channel microphone arrays capturing a sound scene, according to some aspects.

FIG. 2 shows an example of multi-channel microphone arrays capturing a sound scene, according to some aspects. In this example, multi-channel microphone arrays 30, 32, and 34 are located at their respective capture locations. Together, they delineate a space, which can be formed by lines that connect each of the microphone arrays. In the space within or on the lines, the hallucinated loudspeaker array can be produced.

Figure 5:
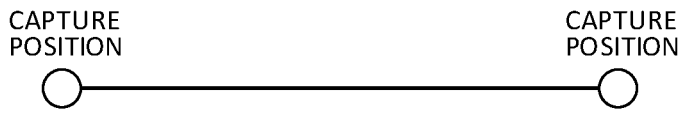
FIG. 5, FIG. 6, and FIG. 7 show examples of capture positions of a sound scene.
Figure 6:
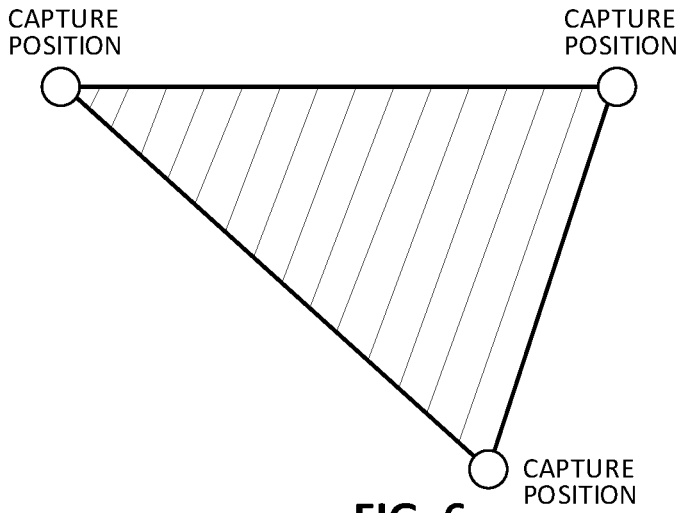
Figure 7:
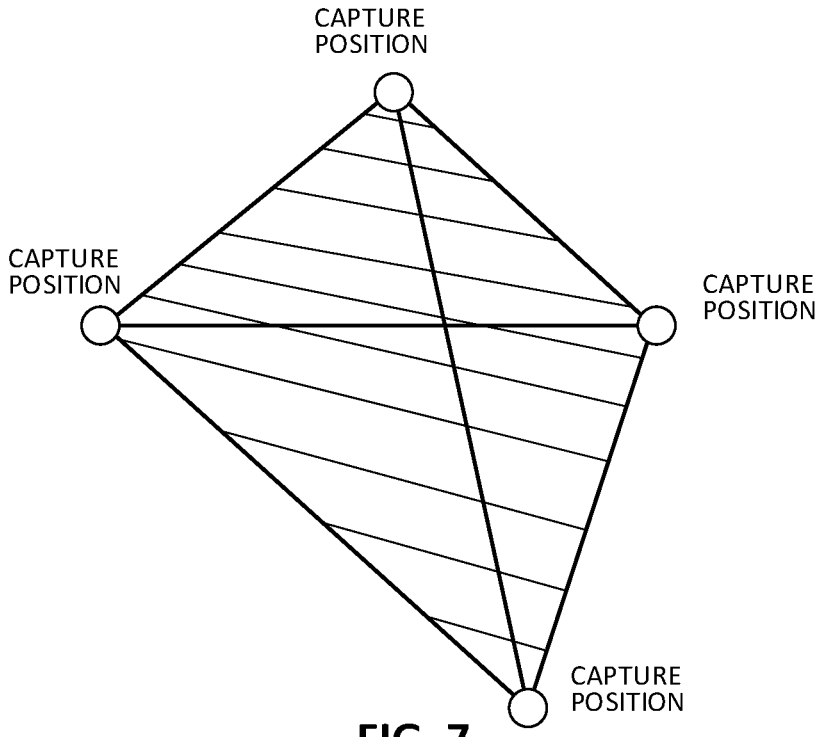

Depending on how many multi-channel microphone arrays are present, the space delineated by the microphone arrays can vary. For example, as shown in FIG. 5, if only two microphone arrays are deployed, then the space can be along the line connecting the microphone arrays. If there are three microphone arrays, then the space can be in the plane, which can take the shape of a triangle, as shown in FIG. 2 and FIG. 6. If there are more than three microphone arrays present, then the hallucinated loudspeaker array can be produced in the three-dimensional volumetric area delineated by the lines connecting the microphone arrays, as shown in FIG. 7. In other words, the physical microphone arrays define "known" auditory origins in space and define the outer bounds into which a hallucinated loudspeaker array or virtual microphone array are rendered.

In some aspects, at least two of the microphone arrays have a different geometry or a different number of channels. For example, referring to FIG. 2, microphone array 30 can be an ambisonic microphone that includes four microphones arranged in tetrahedral shape. Microphone array 32 can be a mobile phone with three microphones arranged on the sides of the device. Because the virtual loudspeaker arrays that are derived from the microphone arrays are uniform, the system and method can accommodate scenarios where multiple users have different recording devices. However, having one or more outlier microphone arrays that not like with the rest may lead to less uniform auditory result in the capture area when the particular outlier array(s) are included in the weighting process, compared to a homogenous system.

Figure 3:
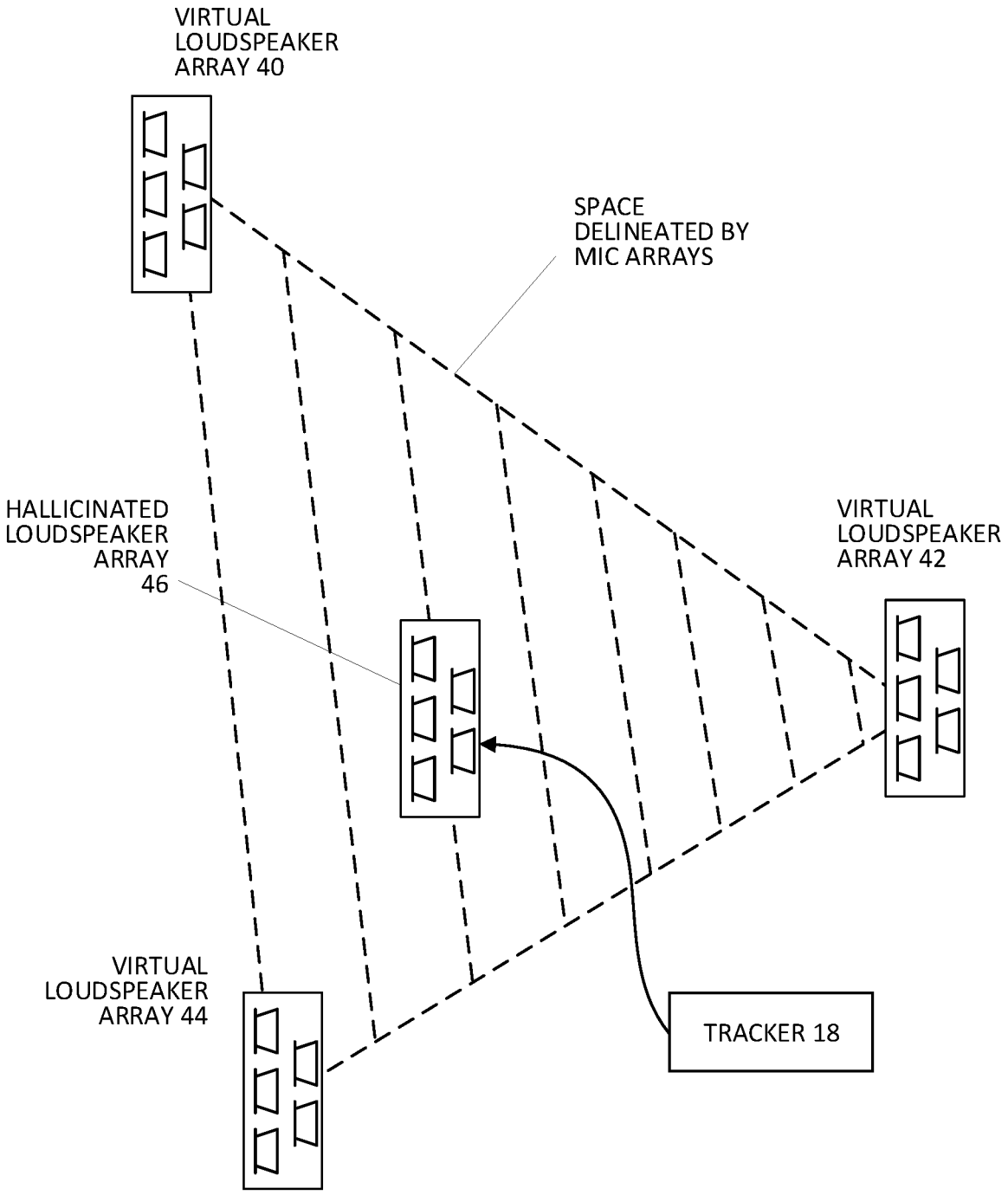
FIG. 3 shows an example of virtual loudspeaker arrays and a hallucinated loudspeaker array, according to some aspects.

FIG. 3 shows an example of virtual loudspeaker arrays and a hallucinated loudspeaker array, according to some aspects. The microphone signals such as those generated by microphone arrays 30, 32, and 34 in FIG. 2 are converted to channels of virtual loudspeaker arrays 40, 42, and 44, respectively. The conversion can be performed by applying an encoding algorithm as discussed in other sections.

Each virtual loudspeaker array can have a central point of origin that can be defined at, or based on each audio capture point of the microphone arrays in space. For example, virtual loudspeaker array 40 can have a point of origin from which its virtual transducers are arranged relative to (thereby defining the geometry of the virtual loudspeaker array 40). The point of origin can be the same as, or based on (e.g., with an offset) the location of microphone array 30 from FIG. 2. As such, each of the capture microphone arrays from FIG. 2 are associated with a corresponding capture location in an acoustic environment, and each virtual loudspeaker array shares or is associated with those capture locations, respectively. A location of the hallucinated loudspeaker array can be delineated or circumscribed by those capture locations that are associated with the plurality of microphone arrays, as described in other sections.

The virtual loudspeaker arrays can have a common geometry. For example, virtual loudspeaker arrays 40, 42, and 44 can each have the same number of virtual transducers arranged in the same direction and location relative to the points of origin of the respective virtual loudspeaker arrays. In some aspects, each virtual loudspeaker can have virtual transducers that are arranged along a grid (e.g., t-design grid) on a flat surface or a three-dimensional shape such as a sphere, a cube, or other shape. The transducers can be arranged in a uniform or semi-uniform manner. The point of origin of each virtual loudspeaker array in the overall coordinate system, however, would be different from each other, being based on the capture locations of the microphone arrays from which they were derived.

The channels of the virtual loudspeaker arrays can be routed down a common audio bus with the same number of channels as the input sources. Translational positional data from tracker 18 can correlate the user's proximity to known auditory points in XR space, which can be mapped to the space delineated by the microphone arrays. The tracker can be integral to a portable device such as a smart phone, tablet computer, HMD, a portable electronic device, or one or more stationary sensors.

Panning and crossfade functions can be performed between the channels of the virtual loudspeaker arrays, to determine their individual contribution level to the common audio bus. Panning can be based on energy or intensity preserving techniques. As a result of phantom imaging between the shared auditory information between like channels of the virtual loudspeaker arrays, the hallucinated loudspeaker array is produced from the output of the common bus. In some aspects, the channels of virtual loudspeaker arrays are not used for reproduction.

Figure 4:
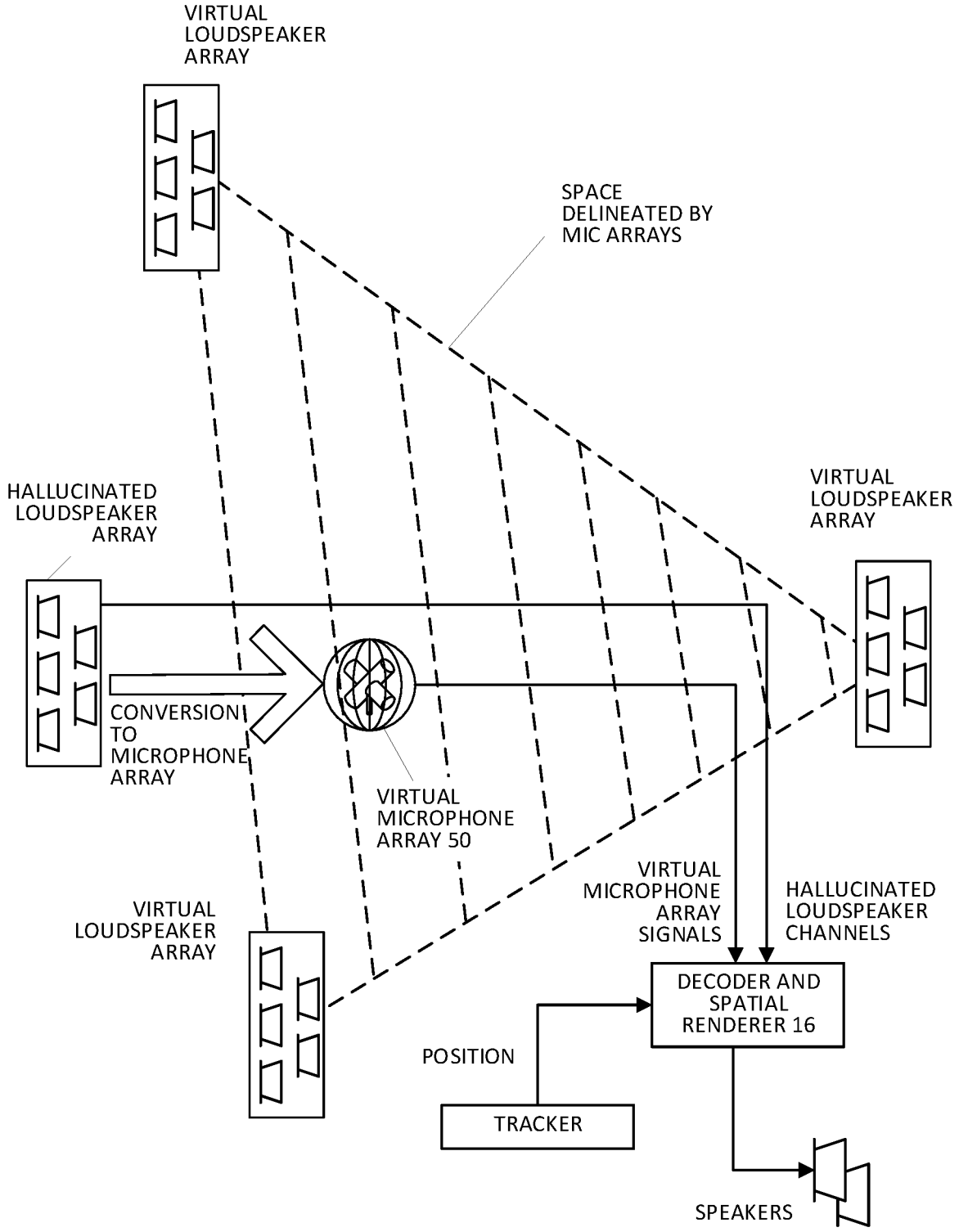
FIG. 4 shows an example of a virtual microphone array and rendering of spatial audio, according to some aspects.

FIG. 4 shows an example of a virtual microphone array and rendering of spatial audio, according to some aspects. As described, spatial audio (e.g., binaural audio) can be produced by directly encoding the channels of the hallucinated loudspeaker array, which can have a standard surround format (e.g., 5.1, 7.2), a cylindrical loudspeaker array, a spherical loudspeaker array, or other geometry. As such, rendering the spatial audio can include applying a decoder (e.g., binaural decoder) to the channels of the hallucinated loudspeaker array, resulting in the spatial audio.

Alternatively, as shown in FIG. 4, the hallucinated loudspeaker array can be converted to a virtual multi-channel microphone array 50, which can be of varying microphone type and geometry, such as, for example, ambisonics, surround capture arrays or other. As such, rendering of the spatial audio can include converting the channels of the hallucinated loudspeaker array to microphone signals of a virtual microphone array such as ambisonics, surround capture arrays or other, that can then be transmitted or rendered with a decoder. A decoder (e.g., a binaural decoder) can be applied to the microphone signals of the virtual microphone array, resulting in the spatial audio.

In an XR application, for example, the virtual microphone array can be an ambisonics microphone array. In such a manner, rotational positional data of a user's head can be used to inform a binaural decoding of the virtual soundfield of the virtual microphone array or of the hallucinated loudspeaker array. The virtual microphone array or hallucinated loudspeaker array serves as a previously non-existent 'virtual' auditory origin between known capture points that is accessible for processing.

Known encoders, such as an ambisonic encoder, or other encoders available as APIs or standalone software, can be applied to the channels of the hallucinated loudspeaker array, to produce the virtual microphone array and microphone signals thereof. In such a manner, the format of the virtual auditory capture point (represented by the virtual microphone array) can be flexible. For example, the format of the virtual microphone array can be chosen to conform to an industry standard or for future-proofing.

Rendering the spatial audio can be performed based on a tracked position of the user, which can include a rotation and/or position of the user's head in three-dimensional space. In some aspects, only the rotation is required because the position of the hallucinated loudspeaker array can be used as a proxy for translational position. Translation can include coordinates in X (along a line); X and Y (on a plane), or X, Y and Z (in three-dimensional space). Rotation can include spherical coordinates such as azimuth and elevation.

Rotation and/or other position data (e.g., translation) of a user can be obtained from a tracker and used to render the speaker array to binaural directly, skipping the soundfield conversion step. However, in practical XR production scenarios it may be beneficial to handle audio soundfield directly as a production asset. Thus, in some aspects, the soundfield created by the virtual microphone can be decoded to produce spatial audio.

Full rotational auditory perception within a virtual soundfield can be provided to the user. Freedom of rotational auditory perception combined with the ability to create a soundfield at any point within the defined capture space (as shown and described in relation to FIG. 3) to provide full freedom of immersive spatial auditory perception anywhere within the space.

Figure 8:
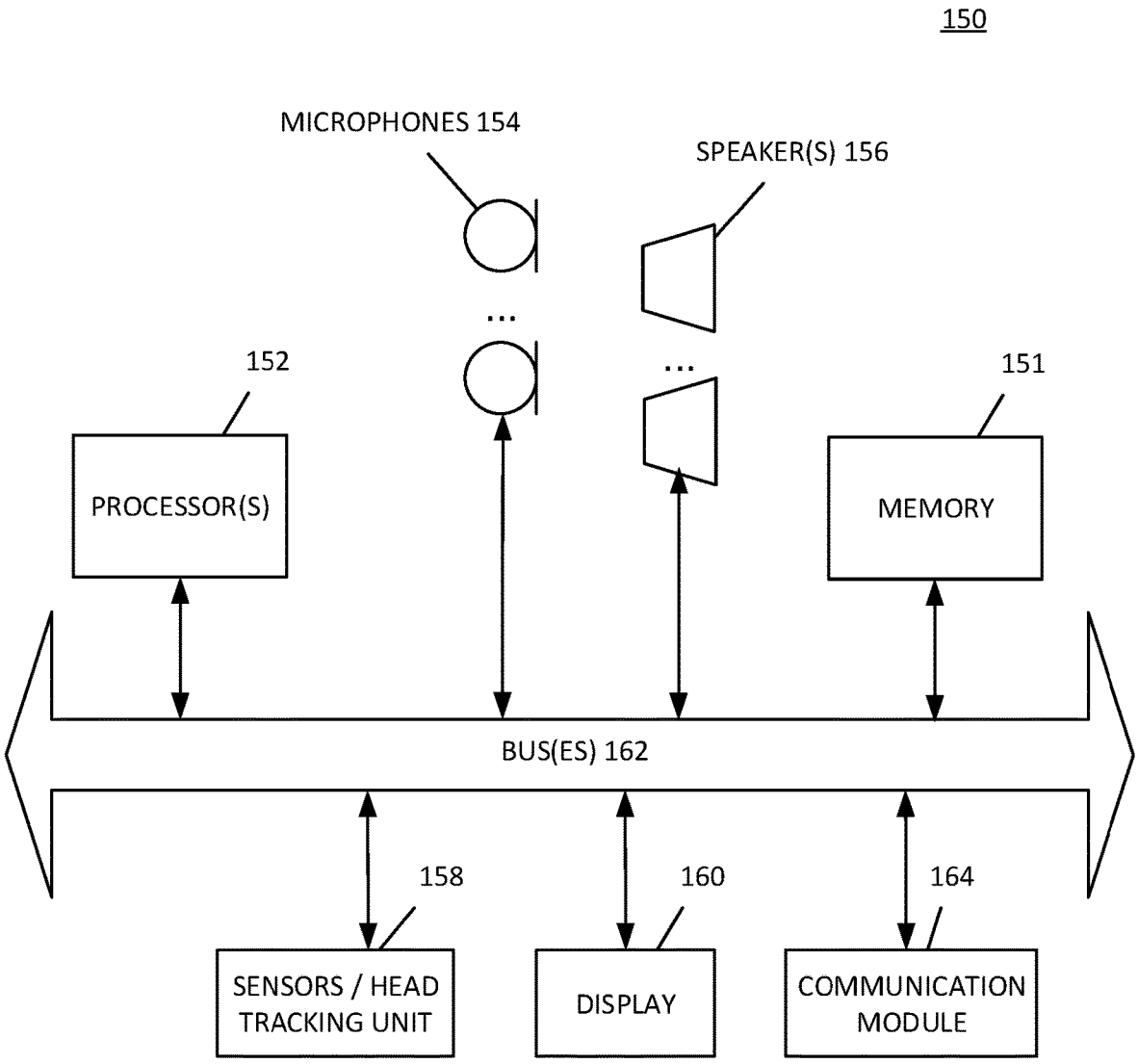
FIG. 8 shows an example of an audio system, according to some aspects.

FIG. 8 shows an example of an audio system, according to some aspects. The audio processing system can be a computing device such as, for example, a desktop computer, a tablet computer, a smart phone, a computer laptop, a smart speaker, a media player, a headphone, a head mounted display (HMD), smart glasses, an infotainment system for an automobile or other vehicle, or an electronic device for presenting XR. The system can be configured to perform the method and processes described in the present disclosure. In some aspects, systems such as those shown in FIG. 1 are implemented as one or more audio processing systems.

Various components of an audio processing system are shown that may be incorporated into headphones, speaker systems, microphone arrays and entertainment systems, this illustration is merely one example of a particular implementation of the types of components that may be present in the audio processing system. This example is not intended to represent any particular architecture or manner of interconnecting the components as such details are not germane to the aspects herein. It will also be appreciated that other types of audio processing systems that have fewer or more components than shown can also be used. Accordingly, the processes described herein are not limited to use with the hardware and software shown.

The audio processing system 150 includes one or more buses 162 that serve to interconnect the various components of the system. One or more processors 152 are coupled to bus 162 as is known in the art. The processor(s) may be microprocessors or special purpose processors, system on chip (SOC), a central processing unit, a graphics processing unit, a processor created through an Application Specific Integrated Circuit (ASIC), or combinations thereof. Memory 151 can include Read Only Memory (ROM), volatile memory, and non-volatile memory, or combinations thereof, coupled to the bus using techniques known in the art. Sensors/head tracking unit 158 can include an IMU and/or one or more cameras (e.g., RGB camera, RGBD camera, depth camera, etc.) or other sensors described herein, that can be used to track a user and/or a user's head. The audio processing system can further include a display 160 (e.g., an HMD, or touchscreen display).

Memory 151 can be connected to the bus and can include DRAM, a hard disk drive or a flash memory or a magnetic optical drive or magnetic memory or an optical drive or other types of memory systems that maintain data even after power is removed from the system. In one aspect, the processor 152 retrieves computer program instructions stored in a machine readable storage medium (memory) and executes those instructions to perform operations described herein.

Audio hardware, although not shown, can be coupled to the one or more buses 162 in order to receive audio signals to be processed and output by speakers 156. Audio hardware can include digital to analog and/or analog to digital converters. Audio hardware can also include audio amplifiers and filters. The audio hardware can also interface with microphones 154 (e.g., microphone arrays) to receive audio signals (whether analog or digital), digitize them if necessary, and communicate the signals to the bus 162.

Communication module 164 can communicate with remote devices and networks. For example, communication module 164 can communicate over known technologies such as Wi-Fi, 3G, 4G, 5G, Bluetooth, ZigBee, or other equivalent technologies. The communication module can include wired or wireless transmitters and receivers that can communicate (e.g., receive and transmit data) with networked devices such as servers (e.g., the cloud) and/or other devices such as remote speakers and remote microphones.

It will be appreciated that the aspects disclosed herein can utilize memory that is remote from the system, such as a network storage device which is coupled to the audio processing system through a network interface such as a modem or Ethernet interface. The buses 162 can be connected to each other through various bridges, controllers and/or adapters as is well known in the art. In one aspect, one or more network device(s) can be coupled to the bus 162. The network device(s) can be wired network devices (e.g., Ethernet) or wireless network devices (e.g., WI-FI, Bluetooth). In some aspects, various aspects described (e.g., simulation, analysis, estimation, modeling, object detection, etc.,) can be performed by a networked server in communication with the capture device.

Various aspects described herein may be embodied, at least in part, in software. That is, the techniques may be carried out in an audio processing system in response to its processor executing a sequence of instructions contained in a storage medium, such as a non-transitory machine-readable storage medium (e.g. DRAM or flash memory). In various aspects, hardwired circuitry may be used in combination with software instructions to implement the techniques described herein. Thus the techniques are not limited to any specific combination of hardware circuitry and software, or to any particular source for the instructions executed by the audio processing system.

In the description, certain terminology is used to describe features of various aspects. For example, in certain situations, the terms "module", "processor", "unit", "renderer", "system", "device", "filter", "localizer", and "component," are representative of hardware and/or software configured to perform one or more processes or functions. For instance, examples of "hardware" include, but are not limited or restricted to an integrated circuit such as a processor (e.g., a digital signal processor, microprocessor, application specific integrated circuit, a micro-controller, etc.). Thus, different combinations of hardware and/or software can be implemented to perform the processes or functions described by the above terms, as understood by one skilled in the art. Of course, the hardware may be alternatively implemented as a finite state machine or even combinatorial logic. An example of "software" includes executable code in the form of an application, an applet, a routine or even a series of instructions. As mentioned above, the software may be stored in any type of machine-readable medium.

Some portions of the preceding detailed descriptions have been presented in terms of algorithms and symbolic representations of operations on data bits within a computer memory. These algorithmic descriptions and representations are the ways used by those skilled in the audio processing arts to most effectively convey the substance of their work to others skilled in the art. An algorithm is here, and generally, conceived to be a self-consistent sequence of operations leading to a desired result. The operations are those requiring physical manipulations of physical quantities. It should be borne in mind, however, that all of these and similar terms are to be associated with the appropriate physical quantities and are merely convenient labels applied to these quantities. Unless specifically stated otherwise as apparent from the above discussion, it is appreciated that throughout the description, discussions utilizing terms such as those set forth in the claims below, refer to the action and processes of an audio processing system, or similar electronic device, that manipulates and transforms data represented as physical (electronic) quantities within the system's registers and memories into other data similarly represented as physical quantities within the system memories or registers or other such information storage, transmission or display devices.

The processes and blocks described herein are not limited to the specific examples described and are not limited to the specific orders used as examples herein. Rather, any of the processing blocks may be re-ordered, combined or removed, performed in parallel or in serial, as necessary, to achieve the results set forth above. The processing blocks associated with implementing the audio processing system may be performed by one or more programmable processors executing one or more computer programs stored on a non-transitory computer readable storage medium to perform the functions of the system. All or part of the audio processing system may be implemented as, special purpose logic circuitry (e.g., an FPGA (field-programmable gate array) and/or an ASIC (application-specific integrated circuit)). All or part of the audio system may be implemented using electronic hardware circuitry that include electronic devices such as, for example, at least one of a processor, a memory, a programmable logic device or a logic gate. Further, processes can be implemented in any combination hardware devices and software components.

While certain aspects have been described and shown in the accompanying drawings, it into be understood that such aspects are merely illustrative of and not restrictive on the broad invention, and the invention is not limited to the specific constructions and arrangements shown and described, since various other modifications may occur to those of ordinary skill in the art.

To aid the Patent Office and any readers of any patent issued on this application in interpreting the claims appended hereto, applicants wish to note that they do not intend any of the appended claims or claim elements to invoke 35 U.S.C. 112(f) unless the words "means for" or "step for" are explicitly used in the particular claim.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. A method, comprising:

producing a plurality of virtual loudspeaker arrays and channels thereof, each based on a corresponding microphone array and microphone signals thereof, wherein each virtual loudspeaker array comprises a same number of virtual loudspeaker transducers that are in a same arrangement within the virtual loudspeaker array, wherein each virtual loudspeaker transducer of the plurality of virtual loudspeaker arrays points in a same direction;

determining channels of a hallucinated loudspeaker array, based on at least some channels of the plurality of virtual loudspeaker arrays, wherein each of the plurality of virtual loudspeaker arrays and the hallucinated loudspeaker array comprises the same number of virtual loudspeaker transducers that are in the same arrangement and that point in the same direction; and rendering spatial audio based on the channels of the hallucinated loudspeaker array.

2. The method of claim 1, wherein rendering the spatial audio includes converting the channels of the hallucinated loudspeaker array to microphone signals of a virtual microphone array, and applying a binaural decoder to the microphone signals of the virtual microphone array, resulting in the spatial audio.

3. The method of claim 2, wherein the virtual microphone array is an ambisonic microphone.

4. The method of claim 1, wherein rendering the spatial audio includes applying a binaural decoder to the channels of the hallucinated loudspeaker array, resulting in the spatial audio.

5. The method of claim 1, wherein each of the microphone arrays is associated with a corresponding capture location in an acoustic environment, and a location of the hallucinated loudspeaker array is delineated by the capture locations that are associated with the plurality of microphone arrays.

6. The method of claim 1, wherein a location of the hallucinated loudspeaker array is determined based on a tracked position of a user.

7. The method of claim 6, wherein the tracked position of the user comprises a translational position of the user in three-dimensional space.

8. The method of claim 1 wherein rendering the spatial audio is further based on a tracked position of a user.

9. The method of claim 8, wherein the tracked position comprises a rotation and position of the user's head in three-dimensional space.

10. The method of claim 1, wherein one or more of the microphone arrays are ambisonic microphones.

11. The method of claim 1, wherein at least two of the microphone arrays have a different geometry or a different number of channels.

12. The method of claim 1, wherein determining channels of the hallucinated loudspeaker array includes determining a contribution of each channel of each of the plurality of virtual loudspeaker arrays to a corresponding channel of the hallucinated loudspeaker array.

13. A system that includes one or more processors configured to perform operations including:

producing a plurality of virtual loudspeaker arrays and channels thereof, each based on a corresponding microphone array and microphone signals thereof, wherein each virtual loudspeaker array comprises a same number of virtual loudspeaker transducers that are in a same arrangement within the virtual loudspeaker array, wherein each virtual loudspeaker transducer of the plurality of virtual loudspeaker arrays points in a same direction;

determining channels of a hallucinated loudspeaker array, based on at least some channels of the plurality of virtual loudspeaker arrays, wherein each of the plurality of virtual loudspeaker arrays and the hallucinated loudspeaker array comprises the same number of virtual loudspeaker transducers that are in the same arrangement and that point in the same direction; and rendering spatial audio based on the channels of the hallucinated loudspeaker array.

14. The system of claim 13, wherein rendering the spatial audio includes converting the channels of the hallucinated loudspeaker array to microphone signals of a virtual microphone array, and applying a binaural decoder to the microphone signals of the virtual microphone array, resulting in the spatial audio.

15. The system of claim 14, wherein the virtual microphone array is an ambisonic microphone.

16. The system of claim 13, wherein rendering the spatial audio includes applying a binaural decoder to the channels of the hallucinated loudspeaker array, resulting in the spatial audio.

17. A device that includes one or more processors configured to perform operations including:

producing a plurality of virtual loudspeaker arrays and channels thereof, each based on a corresponding microphone array and microphone signals thereof, wherein each virtual loudspeaker array comprises a same number of virtual loudspeaker transducers that are in a same arrangement within the virtual loudspeaker array, wherein each virtual loudspeaker transducer of the plurality of virtual loudspeaker arrays points in a same direction;

determining channels of a hallucinated loudspeaker array, based on the channels of the plurality of virtual loudspeaker arrays, wherein each of the plurality of virtual loudspeaker arrays and the hallucinated loudspeaker array comprises the same number of virtual loudspeaker transducers that are in the same arrangement and that point in the same direction; and rendering spatial audio based on the channels of the hallucinated loudspeaker array.

18. The device of claim 17, wherein rendering the spatial audio includes converting the channels of the hallucinated loudspeaker array to microphone signals of a virtual microphone array, and applying a binaural decoder to the microphone signals of the virtual microphone array, resulting in the spatial audio.

19. The device of claim 18, wherein the virtual microphone array is an ambisonic microphone.

* * * * *